US007025284B2

(12) United States Patent
Boehland

(10) Patent No.: US 7,025,284 B2
(45) Date of Patent: Apr. 11, 2006

(54) FUEL INJECTION SYSTEM FOR AN INTERNAL COMBUSTION ENGINE

(75) Inventor: Peter Boehland, Marbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/474,754

(22) PCT Filed: Dec. 6, 2002

(86) PCT No.: PCT/DE02/04480

§ 371 (c)(1),
(2), (4) Date: Mar. 15, 2004

(87) PCT Pub. No.: WO03/069154

PCT Pub. Date: Aug. 21, 2003

(65) Prior Publication Data

US 2004/0144365 A1 Jul. 29, 2004

(30) Foreign Application Priority Data

Feb. 12, 2002 (DE) ..... 102 05 750

(51) Int. Cl.
*F02M 47/02* (2006.01)
*B05B 1/30* (2006.01)
*B05B 9/00* (2006.01)

(52) U.S. Cl. ..... 239/88; 239/585.5; 239/96; 239/533.2; 239/124; 239/127

(58) Field of Classification Search ..... 239/585.5, 239/585.1, 88, 96, 533.9, 533.3, 584, 124, 239/127, 102.2
See application file for complete search history.

(56) References Cited

U.S. PATENT DOCUMENTS 5,893,350 A 4/1999 Timms ..... 123/467
6,267,306 B1 7/2001 Phillips et al. ..... 239/585.1
6,540,160 B1 * 4/2003 Rodriguez-Amaya et al. ..... 239/533.2
6,634,569 B1 * 10/2003 Boecking ..... 239/88
6,637,670 B1 * 10/2003 Rodriguez-Amaya et al. ..... 239/88
6,808,124 B1 * 10/2004 Egler ..... 239/88
2002/0020759 A1 * 2/2002 Boecking ..... 239/96
2002/0152992 A1 10/2002 Rodriguez et al. ..... 123/446
2003/0010846 A1 1/2003 Rodriguez et al. ..... 239/533.2

FOREIGN PATENT DOCUMENTS

EP 0823550 2/1998

(Continued)

*Primary Examiner*—David A. Scherbel
*Assistant Examiner*—Seth Barney
(74) *Attorney, Agent, or Firm*—Ronald E. Greigg

(57) ABSTRACT

A fuel injection system having a high-pressure fuel pump and a fuel injection valve connected to it for each cylinder of the internal combustion engine. A pump piston of the high-pressure fuel pump delimits a pump working chamber that is connected to a pressure chamber of the fuel injection valve, which has an injection valve element that controls injection openings and can be moved in an opening direction counter to a closing force by the pressure prevailing in the pressure chamber. A first control valve controls a connection of the pump working chamber to a relief chamber and a second control valve controls a connection of a control pressure chamber which communicates with the pump working chamber, to a relief chamber. A throttle restriction is respectively provided in connections of the control pressure chamber to the pump working chamber and the relief chamber. An additional pressure chamber is provided, which is connected to the pump working chamber and is delimited by a pressure surface that is used to exert an additional force on the injection valve element in the closing direction.

12 Claims, 4 Drawing Sheets

FOREIGN PATENT DOCUMENTS

| | | |
|---|---|---|
| EP | 0987431 | 3/2000 |
| EP | 1236884 | 9/2002 |
| EP | 1260700 | 11/2002 |
| WO | 02070889 | 9/2002 |

* cited by examiner

FUEL INJECTION SYSTEM FOR AN INTERNAL COMBUSTION ENGINE

CROSS-REFERENCE TO RELATED APPLICATIONS

This application is a 35 USC 371 application of PCT/DE 02/04480 filed on Dec. 06, 2002.

BACKGROUND OF THE INVENTION

1. Field of the Invention

The invention is directed to an improved fuel injection system for an internal combustion engine.

2. Description of the Prior Art

A fuel injection system known from EP 0 987 431 A2 has a high-pressure fuel pump and a fuel injection valve connected to it for each cylinder of the internal combustion engine. The high-pressure fuel pump has a pump piston that delimits a pump working chamber and is driven into a stroke motion by the engine. The fuel injection valve has a pressure chamber connected to the pump working chamber and an injection valve element that controls at least one injection opening; the pressure prevailing in the pressure chamber can move the injection valve element in the opening direction counter to a closing force in order to open the at least one injection opening. A first electrically actuated control valve controls a connection of the pump working chamber to a relief chamber and a second electrically actuated control valve controls a connection of a control pressure chamber to a relief chamber. A control piston delimits the control pressure chamber and the action of the pressure prevailing in the control pressure chamber on the control piston causes it to act on the injection valve element in a closing direction; the control piston can move in concert with the injection valve element. The control pressure chamber has a connection to the pump working chamber. For an injection of fuel, the first control valve is closed and the second control valve is opened so that high pressure cannot build up in the control pressure chamber and the fuel injection valve can open. When the second control valve is open, though, fuel flows out of the pump working chamber via the control pressure chamber, thus reducing the fuel quantity available for injection out of the fuel quantity supplied by the pump piston and also reducing the pressure available for the injection. It follows from this that the efficiency of the fuel injection system is not optimal.

SUMMARY AND ADVANTAGES OF THE INVENTION

The fuel injection system according to the invention has the advantage over the prior art of allowing the end surface of the control piston that is acted on by the pressure prevailing in the control pressure chamber to be kept small, which, with the minimum flow cross sections of the throttle restrictions required for the function, makes it possible to minimize the fuel quantity that flows out when the second control valve is open, thus improving the efficiency of the fuel injection system.

Advantageous embodiments and modifications of the fuel injection system according to the invention are disclosed. One embodiment makes it simple to provide the additional pressure surface, while another permits a simple design of the fuel injection system.

BRIEF DESCRIPTION OF THE DRAWINGS

The invention is explained in detail herein below, with reference to the drawings, in which.

DESCRIPTION OF THE PREFERRED EMBODIMENTS

Figure 1:
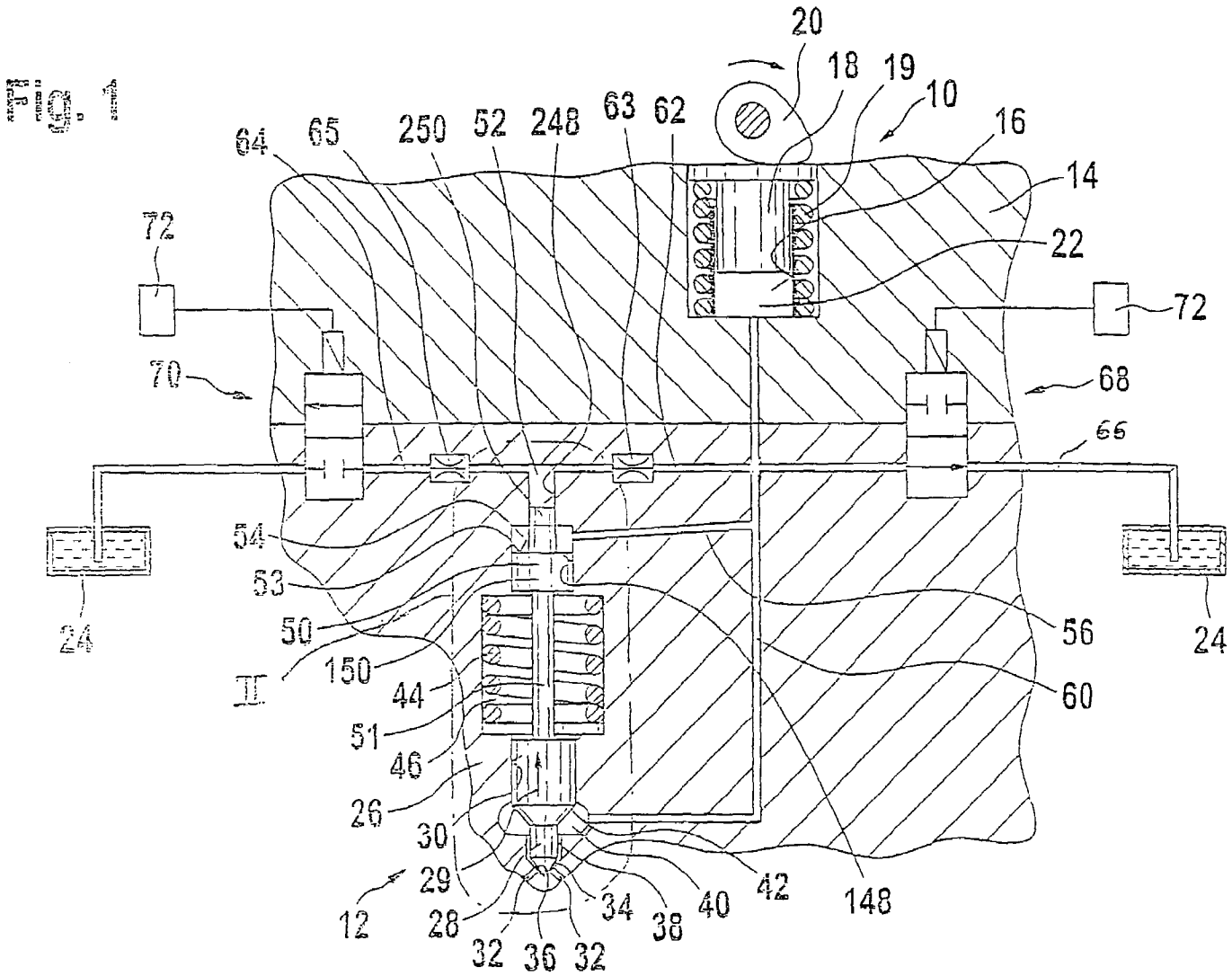
FIG. 1 schematically depicts a fuel injection system for an internal combustion engine.
Figure 2:
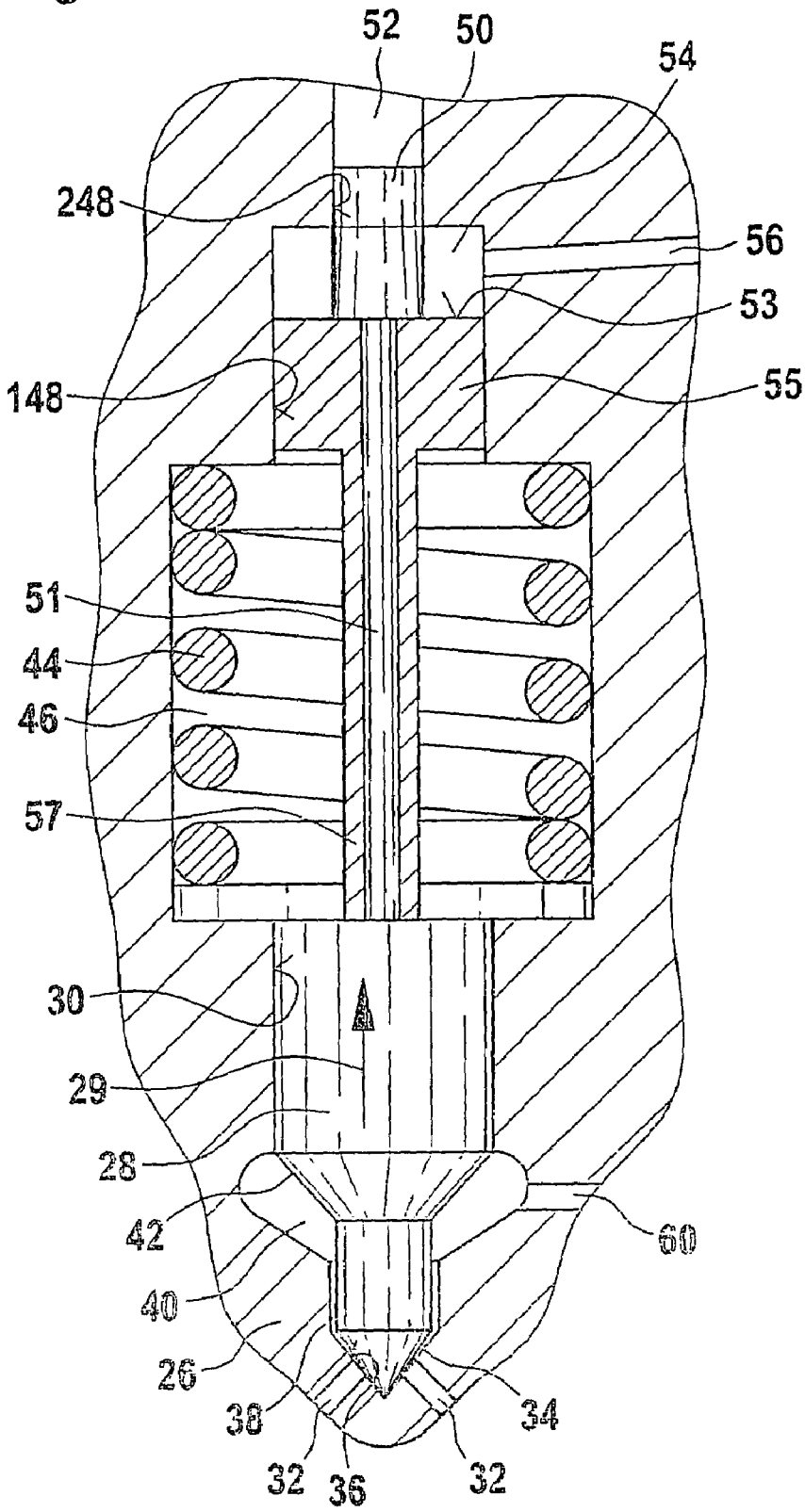
FIG. 2 depicts an enlarged detail, labeled II in FIG. 1, of the fuel injection system according to a modified embodiment.
Figure 3:
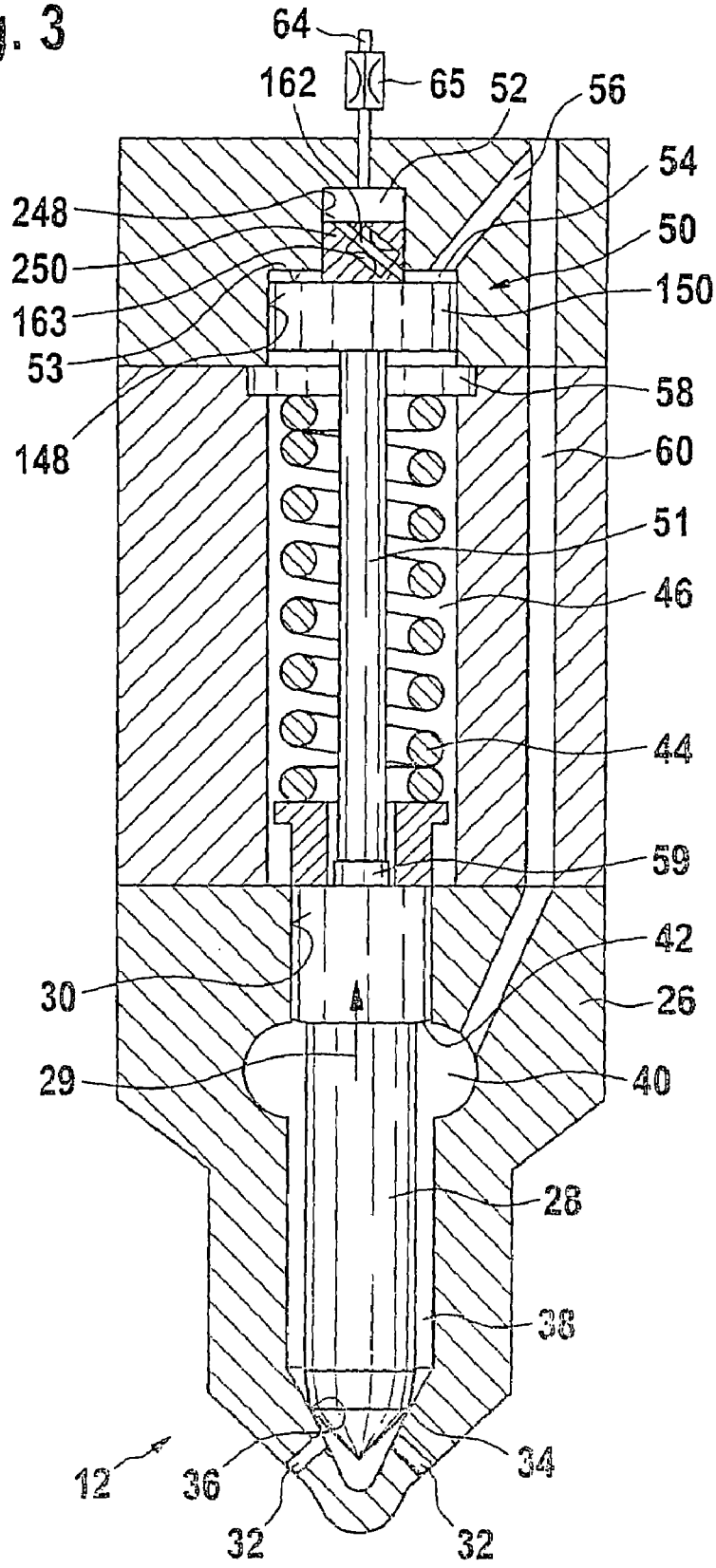
FIG. 3 depicts the detail 11 of the fuel injection system according to another modified embodiment.

FIGS. 1 to 3 show a fuel injection system for an internal combustion engine of a motor vehicle. The engine is preferably an internal combustion engine with autoignition. The fuel injection system is preferably embodied as a so-called unit fuel injector and, for each cylinder of the engine, has a high-pressure fuel pump 10 and a fuel injection valve 12 connected to it, which comprise a common component. Alternatively, the fuel injection system can also be embodied as a so-called unit pump system, in which the high-pressure fuel pump and the fuel injection valve of each cylinder are disposed separately from each other and are connected to each other via a line. The high-pressure fuel pump 10 has a pump body 14 with a cylinder bore 16 in which a pump piston 18 is guided in a sealed fashion, which piston is set into a stroke motion counter the force of a return spring 19, at least indirectly by means of a cam 20 of a camshaft of the engine. In the cylinder bore 16, the pump piston 18 delimits a pump working chamber 22 in which fuel is compressed at high pressure during the delivery stroke of the pump piston 18. The pump working chamber 22 is supplied with fuel from a fuel tank 24 of the motor vehicle.

The fuel injection valve 12 has a valve body 26 that is connected to the pump body 14 and can be composed of a number of parts; an injection valve element 28 is guided in a longitudinally sliding fashion in a bore 30 in this valve body 26. In its end region oriented toward the combustion chamber of the cylinder of the engine, the valve body 26 has at least one, preferably several injection openings 32. In its end region oriented toward the combustion chamber, the injection valve element 28 has a sealing surface 34 that is approximately conical, for example, and that cooperates with a valve seat 36 embodied in the end region of the valve body 26 oriented toward the combustion chamber; the injection openings 32 branch off from this valve seat 36 or branch off downstream of it. In the valve body 26, between the injection valve element 28 and the bore 30, toward the valve seat 36, there is an annular space 38 whose end region oriented away from the valve seat 36, by means of a radial enlargement of the bore 30, transitions into a pressure chamber 40 that encompasses the injection valve element 28. At the level of the pressure chamber 40, the injection valve element 28 has a pressure shoulder 42 formed by a cross sectional reduction. The end of the injection valve element 28 oriented away from the combustion chamber is engaged by a prestressed closing spring 44, which presses the injection valve element 28 toward the valve seat 36. The closing spring 44 is disposed in a spring chamber 46 of the valve body 26, adjoining the bore 30.

At its end oriented away from the bore 30, the spring chamber 46 is adjoined by an additional stepped bore in the valve body 26, in which a control piston 50 is guided in a sealed fashion, connected to the injection valve element 28. This stepped bore is embodied with a stepped diameter and has a large-diameter section 148 oriented toward the spring chamber 46 and a small-diameter section 248 oriented away from the spring chamber 46. The control piston 50 is embodied with a correspondingly stepped diameter and has a large-diameter region 150 guided in a sealed fashion in the bore section 148 and a small-diameter region 250 guided in a sealed fashion in the bore section 248. The end surface of the region 250 of the control piston 50 functions as a moving wall that delimits a control pressure chamber 52 in the bore section 248. At the transition between the regions 150, 250, in the region 150 of the control piston 50, an annular pressure surface 53 is formed, with which the region 150 of the control piston 50 delimits an additional pressure chamber 54 in the bore section 148. The control piston 50 is connected to the injection valve element 28 by means of a piston rod 51 whose diameter is smaller than that of the control piston. The control piston 50 can be of one piece with the injection valve element 28, but for assembly reasons, is preferably embodied as a separate part that is attached to the injection valve element 28.

A conduit 60 leads from the pump working chamber 22, through the pump body 14 and the valve body 26 to the pressure chamber 40 of the fuel injection valve 12. A conduit 62 leads from the pump working chamber 22 or the conduit 60 to the control pressure chamber 52. The control pressure chamber 52 is also fed by a conduit 64, which produces a connection to a relief chamber, which function can be served at least indirectly by the fuel tank 24 or another region in which a low pressure prevails. A connection 66 leads from the pump working chamber 22 or the conduit 60 to a relief chamber 24 and is controlled by means of a first electrically actuated control valve 68. The control valve 68 can, as shown in FIG. 1, be embodied as a 2/2-port directional control valve. The connection 64 of the control pressure chamber 52 to the relief chamber 24 is controlled by a second electrically actuated control valve 70, which can be embodied as a 2/2-port directional control valve. A throttle restriction 63 is provided in the connection 62 of the control pressure chamber 52 to the pump working chamber 22 and a throttle restriction 65 is provided in the connection of the control pressure chamber 52 to the relief chamber 24. The supply of fuel from the pump working chamber 22 into the control pressure chamber 52 and the outflow of fuel from the control pressure chamber 52 can be set to the necessary amounts through suitable dimensioning of the throttle restrictions 63, 65. A sufficient supply of fuel to the control pressure chamber 52 is necessary for a rapid closing of the fuel injection valve 12 and a sufficient outflow of fuel from the control pressure chamber 52 is necessary for a rapid opening of the fuel injection valve 12. The control valves 68, 70 can have an electromagnetic actuator or a piezoelectric actuator and are triggered by an electronic control unit 72.

The additional pressure chamber 54 is connected to the pump working chamber 22 by means of a connection 56, for example in the form of a conduit, which can feed into the conduit 60, for example. The connection 56 does not contain a throttle restriction. The additional pressure chamber 54 is therefore connected to the pump working chamber 22 directly, bypassing the throttle restriction 63 of the connection 62 of the control pressure chamber 52 to the pump working chamber 22, and the same pressure that prevails in the pump working chamber 22 and the pressure chamber 40 consequently acts on the pressure surface 53 of the control piston 50. By means of the pressure surface 53 and the control piston 50, the pressure prevailing in the additional pressure chamber 54 generates a force on the injection valve element 28 in the closing direction that works in concert with the closing spring 44. By means of the pressure surface of the control piston 50, the pressure prevailing in the pressure chamber 52 also generates a force on the injection valve element 28 in the closing direction that works in concert with the closing spring 44. The second control valve 70 controls the pressure in the control pressure chamber 52; when the control valve 70 is closed, at least approximately the same pressure prevails in the control pressure chamber 52 as in the pump working chamber 22 and the additional pressure chamber 54, whereas when the control valve 70 is open, a lower pressure prevails in the control pressure chamber 52 because of the connection to the relief chamber 24. The closing force that in sum acts on the injection valve element 28 consequently depends on the force of the closing spring 44, the pressure prevailing in the control pressure chamber 52 controlled by the second control valve 70, and the pressure prevailing in the additional pressure chamber 54, which is equal to the pressure prevailing in the pump working chamber 22 and in turn depends on the delivery stroke of the pump piston 18.

FIG. 2 shows a detail of a modified embodiment of the fuel injection system in which the fundamental design is the same as the one described above, but the pressure surface 53 is embodied on a piston 55 that is separate from the control piston 50. The control piston 50 here has only the control piston region 250 that is guided in a sealed fashion in the bore section 248 and delimits the control pressure chamber 52 with its end surface. The control piston 50 is connected to the injection valve element 28 by means of the piston rod 51. The piston 55 replaces the control piston region 150 of the embodiment according to FIG. 1 and is likewise connected to the injection valve element 28 by means of a piston rod 57; the piston rod 51 of the control piston 50 passes through the piston 55 and its piston rod 57.

FIG. 3 shows a detail of a modified embodiment of the fuel injection system in which the fundamental design is once again the same as in the embodiment described in FIG. 1, but the design of the control piston and the connection of the control pressure chamber 52 to the pump working chamber 22 are modified. The control piston 50 once again has the region 150 guided in a sealed fashion in the larger-diameter bore section 148 and the region 250 guided in a sealed fashion in the smaller-diameter bore section 248. The end surface of the control piston region 250 delimits the control pressure chamber 52 and the annular pressure surface 53 of the control piston region 150 delimits the additional pressure chamber 54. The additional pressure chamber 54 is connected via the connection 56 to the conduit 60, and by means of it, is connected to the pump working chamber 22. The control piston region 250 contains a connection 162, for example in the form of a bore, which connects the control pressure chamber 52 to the additional pressure chamber 54. The connection 162 contains a throttle restriction 163, which can be comprised of the connection 162 itself, provided that this is embodied with an appropriately small cross section. The connection 64 leads from the control pressure chamber 52 to the relief chamber 24, is controlled by the second control valve 70, and is provided with the throttle restriction 65. By contrast with the embodiment according to FIG. 1, the bore section 148 has the same diameter as the spring chamber 46. In order to separate the bore section 148 from the spring chamber 46, an intermediary disk 58 is provided, which supports the closing spring 44 in the spring chamber 46. Between the piston rod 51 and the injection valve element 28, a compensating disk 59 can be provided, which can be used to adjust the distance between the control piston 50 and the injection valve element 28.

Figure 4:
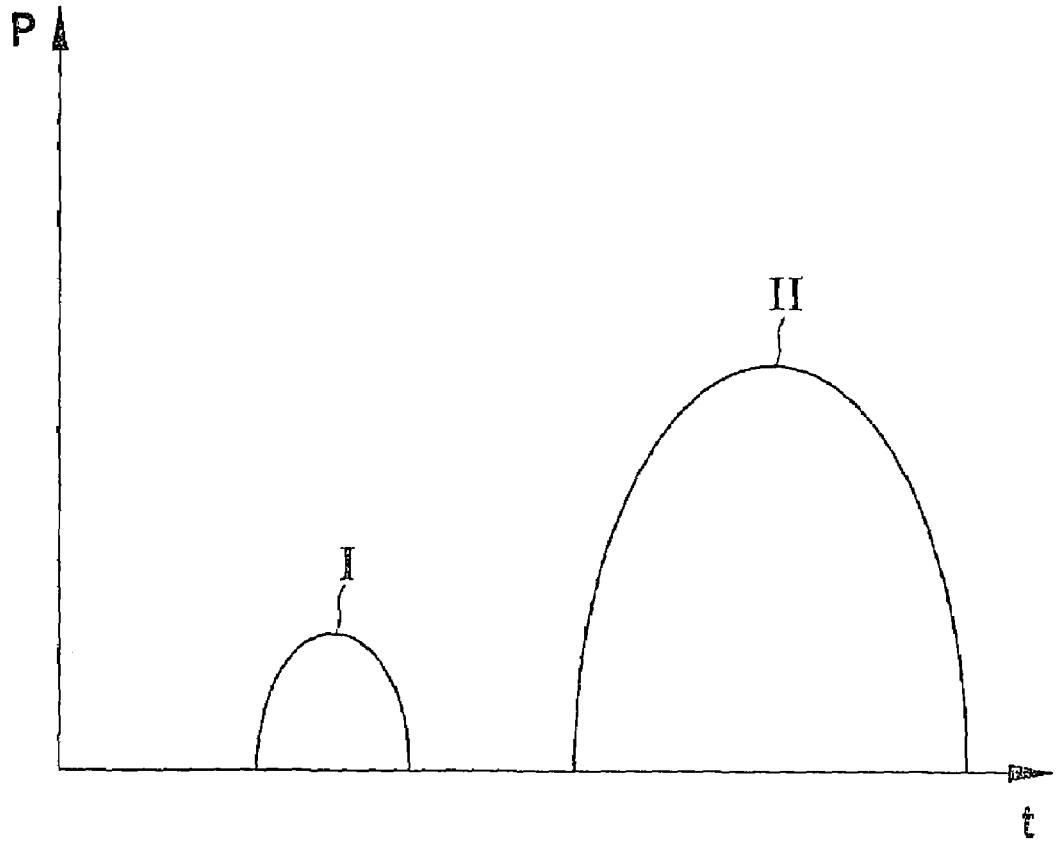
FIG. 4 depicts the curve of a pressure at injection openings of a fuel injection valve of the fuel injection system.

The function of the fuel injection system will be explained below. FIG. 4 shows the curve of the pressure p at the injection openings 32 of the fuel injection valve 12 over time t during an injection cycle. During the intake stroke of the pump piston 18, it is supplied with fuel from the fuel tank 24. During the delivery stroke of the pump piston 18, the fuel injection begins with a preinjection, in which the control unit 72 closes the first control valve 68 so that the pump working chamber 22 is disconnected from the relief chamber 24. The control unit 72 also opens the second control valve 70 so that the control pressure chamber 52 is connected to the relief chamber 24. In this instance, high pressure cannot build up in the control pressure chamber 52 since it is pressure relieved in the direction of the relief chamber 24. However, a small quantity of fuel can flow out of the pump working chamber 22 to the relief chamber 24 via the throttle restrictions 63 and 65 so that the full high pressure that would build up if the second control valve 70 were closed cannot build up in the pump working chamber 22. The same pressure prevails in the additional pressure chamber 54 as in the pump working chamber 22 and the pressure chamber 40. If the pressure in the pump working chamber 22 and therefore in the pressure chamber 40 of the fuel injection valve 12 is great enough for the compressive force that it exerts on the injection valve element 28 via the pressure shoulder 42 to exceed the sum of the force of the closing spring 44, the compressive force exerted on the control piston 50 by the residual pressure prevailing in the control pressure chamber 52, and the compressive force on the pressure surface 53 exerted by the pressure prevailing in the additional pressure chamber 54, then the injection valve element 28 moves in the opening direction 29 and opens the at least one injection opening 32. In order to terminate the preinjection, the control unit closes the second control valve 70 so that the control pressure chamber 52 is disconnected from the relief chamber 24. The first control valve 68 remains in its closed position. As a result, the same high pressure as in the pump working chamber 22 builds up in the control pressure chamber 52 so that a powerful compressive force acts on the control piston 50 in the closing direction. In addition, when the second control valve 70 is closed, the pressure in the pump working chamber 22 and therefore also in the additional pressure chamber 54 increases so that an increased force in the closing direction is also exerted on the injection valve element 28 by means of the pressure surface 53. Since the force acting on the injection valve element 28 in the opening direction 29 is then less than the sum of the force of the closing spring 44, the compressive force on the control piston 50, and the compressive force on the pressure surface 53, the fuel injection valve 12 closes. The preinjection corresponds to an injection phase labeled I in FIG. 4.

For a subsequent main injection that corresponds to an injection phase labeled II in FIG. 4, the control unit 72 opens the second control valve 70 so that the pressure in the control pressure chamber 52 decreases. The fuel injection valve 12 then opens due to the reduced compressive force on the control piston 50, and the injection valve element 28 travels for its maximal opening stroke. In order to limit the opening stroke motion of the injection valve element 28 and the control piston 50, the pressure surface 53 can come into contact with the annular shoulder formed at the transition between the bore sections 148 and 248. However, the injection valve element 28 can also be provided with a different stroke stop to limit its opening motion. When the second control valve 70 is open, a small quantity of fuel flows out via the throttle restrictions 63, 65 to the relief chamber 24, but the throttle restrictions 63, 65 can be embodied with a small flow cross section so that the fuel quantity flowing out and the reduction of the pressure in the pump working chamber 22 are small.

In order to terminate the main injection, the control unit 72 brings the first control valve 68 into its open switched position so that the pump working chamber 22 is connected to the relief chamber 24 and only a slight compressive force acts on the injection valve element 28 in the opening direction 29; the fuel injection valve 12 closes due to the force of the closing spring 44, the force exerted on the control piston 50 by the residual pressure prevailing in the control pressure chamber 52, and the force exerted on the pressure surface 53 in the additional pressure chamber 54. The second control valve 70 can be in either its open position or its closed position upon termination of the main injection.

In the above-explained embodiments of the fuel injection system, it is also possible for the flow cross section from the control pressure chamber 52 to the relief chamber 24 to be controlled by the control piston 50 in a variable fashion as a function of its stroke. In a stroke position corresponding to the closed position of the injection valve element 28, the control piston 50 here opens a greater flow cross section and in a stroke position corresponding to the open position of the injection valve element 28, a smaller flow cross section is opened.

The foregoing relates to preferred exemplary embodiments of the invention, it being understood that other variants and embodiments thereof are possible within the spirit and scope of the invention, the latter being defined by the appended claims.

What is claimed is:

1. In a fuel injection system for an internal combustion engine, having a high-pressure fuel pump (10) and a fuel injection valve (12) connected to it for each cylinder of the engine, the high-pressure fuel pump (10) having a pump piston (18) that is driven into a stroke motion by the engine and delimits a pump working chamber (22), which is supplied with fuel from a fuel tank (24), the fuel injection valve (12) having a pressure chamber (40) connected to the pump working chamber (22) and an injection valve element (28) that controls at least one injection opening (32), and the pressure prevailing in the pressure chamber (40) can act on the injection valve element (28) in an opening direction (29) counter to a closing force in order to open the at least one injection opening (32), having a first control valve (68) that controls a connection (66) of the pump working chamber (22) to a relief chamber (24), and having a second control valve (70) that controls a connection (64) of a control pressure chamber (52) to a relief chamber (24), wherein the control pressure chamber (52) is delimited by a control piston (50), which, due to the action of the pressure prevailing in the control pressure chamber (52), acts in a closing direction on the injection valve element (28) and can move in concert with the injection valve element (28), wherein the control pressure chamber (52) has a connection (62) to the pump working chamber (22), the improvement comprising a throttle restriction (63, 65) is respectively provided in the connections (62, 64) of the control pressure chamber (52) to the pump working chamber (22) and to the relief chamber (24), and an additional pressure chamber (54) connected to the pump working chamber (22) and delimited by a pressure surface (53) that is used to exert an additional force on the injection valve element (28) in the closing direction.

2. The fuel injection system according to claim 1, wherein the pressure surface (53) is embodied as an annular surface on a separate piston (55) encompassing the control piston (50).

3. The fuel injection system according to claim 1, wherein the pressure surface (53) is embodied on the control piston (50), which is embodied as stepped in cross section, wherein the control piston (50) delimits the control pressure chamber (52) with the end surface of a small-diameter region (250), and wherein the pressure surface (53) is embodied as an annular surface on a cross-sectionally larger region (150) of the control piston (50), at the transition to the cross-sectionally smaller region (250).

4. The fuel injection system according to claim 1, wherein the additional pressure chamber (54) is connected directly to the pump working chamber (22), bypassing the throttle restriction (63) of the connection (62) of the control pressure chamber (52) to the pump working chamber (22).

5. The fuel injection system according to claim 2, wherein the additional pressure chamber (54) is connected directly to the pump working chamber (22), bypassing the throttle restriction (63) of the connection (62) of the control pressure chamber (52) to the pump working chamber (22).

6. The fuel injection system according to claim 3, wherein the additional pressure chamber (54) is connected directly to the pump working chamber (22), bypassing the throttle restriction (63) of the connection (62) of the control pressure chamber (52) to the pump working chamber (22).

7. The fuel injection system according to claim 1, wherein the control pressure chamber (52) is connected to the pump working chamber (22) via the additional pressure chamber (54), and wherein a throttle restriction (163) is provided in a connection (162) disposed between the control pressure chamber (52) and the additional pressure chamber (54).

8. The fuel injection system according to claim 2, wherein the control pressure chamber (52) is connected to the pump working chamber (22) via the additional pressure chamber (54), and wherein a throttle restriction (163) is provided in a connection (162) disposed between the control pressure chamber (52) and the additional pressure chamber (54).

9. The fuel injection system according to claim 3, wherein the control pressure chamber (52) is connected to the pump working chamber (22) via the additional pressure chamber (54), and wherein a throttle restriction (163) is provided in a connection (162) disposed between the control pressure chamber (52) and the additional pressure chamber (54).

10. The fuel injection system according to claim 7, wherein the connection (162) of the control pressure chamber (52) to the additional pressure chamber (54) is produced by means of at least one conduit in the control piston (50).

11. The fuel injection system according to claim 8, wherein the connection (162) of the control pressure chamber (52) to the additional pressure chamber (54) is produced by means of at least one conduit in the control piston (50).

12. The fuel injection system according to claim 9, wherein the connection (162) of the control pressure chamber (52) to the additional pressure chamber (54) is produced by means of at least one conduit in the control piston (50).

* * * * *